US006865848B2

(12) United States Patent
Krimmel

(10) Patent No.: US 6,865,848 B2
(45) Date of Patent: Mar. 15, 2005

(54) SLIDING ELEMENT SYSTEM WHICH INCLUDES A SINGLE SUPPORT ROD DEFINING TWO MUTUALLY INSULATED ELECTRICALLY CONDUCTIVE PATHS

(76) Inventor: Maria Krimmel, Am Jausenteich 31, 72458 Albstadt (DE)

( * ) Notice: Subject to any disclaimer, the term of this patent is extended or adjusted under 35 U.S.C. 154(b) by 103 days.

(21) Appl. No.: 10/259,286

(22) Filed: Sep. 30, 2002

(65) Prior Publication Data

US 2003/0172592 A1 Sep. 18, 2003

(30) Foreign Application Priority Data

Mar. 12, 2002 (EP) ..... 02005612

(51) Int. Cl.[7] ..... E05D 15/06
(52) U.S. Cl. ..... 49/409; 49/70
(58) Field of Search ..... 49/70, 409, 410, 49/411, 413; 40/547, 550, 540, 452

(56) References Cited

U.S. PATENT DOCUMENTS 3,425,162 A * 2/1969 Halpern ..... 49/425
3,644,741 A * 2/1972 Ovshinsky ..... 250/214 LA
4,099,599 A * 7/1978 Randall ..... 187/313
4,152,712 A * 5/1979 Myers ..... 257/93
4,645,970 A * 2/1987 Murphy ..... 313/509
4,970,812 A * 11/1990 Tanaka et al. ..... 40/452
5,636,462 A * 6/1997 Kleiman ..... 40/452
6,082,053 A * 7/2000 Bischof et al. ..... 52/64
6,233,878 B1 * 5/2001 Krahenbuhl et al. ..... 52/64
6,323,429 B1 * 11/2001 Platz ..... 174/117 FF
6,591,527 B2 * 7/2003 Park ..... 40/564

FOREIGN PATENT DOCUMENTS

EP 0 995 199 B1 6/1998

* cited by examiner

*Primary Examiner*—Gregory J. Strimbu
(74) *Attorney, Agent, or Firm*—Diller, Ramik & Wight

(57) ABSTRACT

A sliding element system with at least one sliding element (2), at least one supporting element (4) extending in a displacement direction, and with at least one sliding element fitting (6,8) displaceable along the supporting element (4) and holding the sliding element (2). The sliding element (2) is formed at least partially of a transparent material and includes at least two transparent conducting current paths (10,12) which invisibly supply power to a power consumer (14) such as an illumination device, of the sliding element (2), and the transparent conducting current paths (10,12) are adapted to be supplied with power via the at least one sliding element fitting (6, 8).

15 Claims, 4 Drawing Sheets

SLIDING ELEMENT SYSTEM WHICH INCLUDES A SINGLE SUPPORT ROD DEFINING TWO MUTUALLY INSULATED ELECTRICALLY CONDUCTIVE PATHS

BACKGROUND OF THE INVENTION

The invention relates to a sliding element system.

Sliding element systems, for example, are known from sliding door systems where the sliding door is arranged displaceably in a vertical position. In case of an appropriate bearing of the sliding element, an arrangement of the sliding element differing from the vertical position is, of course, possible as well.

Sliding doors are known for partitioning rooms, as furniture elements and in showers as well. If transparent sliding elements or sliding elements including glass panes are used, it is often desired to arrange light-technical installations or sensors on or in the sliding element, but there arises the problem to invisibly supply a power consumer located on the transparent surface with electric power, particularly if the sliding element is movable.

OBJECT OF THE INVENTION

It is the object of the present invention to provide a sliding element system with sliding elements wherein it is possible to invisibly supply power consumers arranged on or in a transparent part of the sliding element with electric power.

This object is solved according to the present invention. The invention advantageously provides that the sliding element consists at least partially of transparent material or comprises transparent elements and comprises at least two transparent conducting current paths in the transparent part, which invisibly supply a power consumer on or in the sliding element with power, and that the transparent current paths of the sliding element are adapted to be supplied with current via the at least one sliding element fitting.

The transparent conducting current paths are made of coatings such as are generally described in the European Patent Application EP 995 199 A. These current paths allow the transfer of a high current intensity of up to more than 20 amperes so that even in low-voltage operation, it is possible to provide power consumers with a sufficient current intensity. Such power consumers, for example, are illumination or signal means with LEDs and/or sensor and communication means.

The power is able to be transferred to the sliding element via at least one sliding element fitting so that a power transfer is possible without any visible conductors.

Preferably, it is provided that the at least one sliding element fitting taps off the power from at least two power rails extending in parallel to the bearing element.

In this case, the supporting element itself is able to serve as power rail.

According to a preferred embodiment, the bearing element consists of a single bearing rod, the at least one sliding element fitting tapping off the current from two longitudinally extending mutually insulated circumferential portions of the bearing rod serving as power rail. This is advantageous in that no separate power rails are required.

Advantageously, it is provided that the bearing rod comprises a conducting bar inserted into a groove in an insulated manner, the metal bearing rod forming the power rail of the one pole and the conducting bar inserted in an insulating manner forming the power rail of the other pole of the power supply. The power can be coupled to one end of the bearing rod.

As an alternative, it may be provided that the bearing element consists of two bearing rods extending in parallel and forming one power rail each, and that the at least one sliding element fitting taps off the power from both bearing rods.

Preferably, two laterally spaced sliding element fittings are provided each of which taps off a power rail of the power supply.

The sliding element fitting comprises at least one castor rolling on the at least one bearing rod.

In an alternative solution, it may be provided that the at least one castor transfers at least one pole of the power from the bearing rod serving as power rail to the sliding element fitting.

Preferably, however, it is provided that the at least one sliding element fitting comprises at least one sliding contact for tapping off power from the power rails.

The at least one sliding contact is mounted to an disengagement preventing means extending below the bearing element. From this disengagement preventing means, power can then be transferred to the sliding element, contacts or cable connections connected to the conducting current paths projecting from the upper front edge of the sliding element.

The sliding element may consist of a glass pane or a multilayer glass pane or a sliding element with a transparent glass insert. In the case of a multilayer glass pane, an electrically insulating elastic intermediate layer is provided between two glass layers in which, for example, the power consumer may be embedded.

The power consumer of the sliding element may be, for example, an illumination means, the illumination means preferably comprising LED diodes.

The power consumer may also be a sensor unit transferring, for example, signals for automatically opening the door to a door control.

Preferably, the sliding element is a sliding door, but may also be a table board, for example.

BRIEF DESCRIPTION OF THE DRAWINGS

Hereinafter, an embodiment of the invention is explained in detail with reference to the drawings. In the Figures.

DETAILED DESCRIPTION OF THE FIGURES

Figure 1:
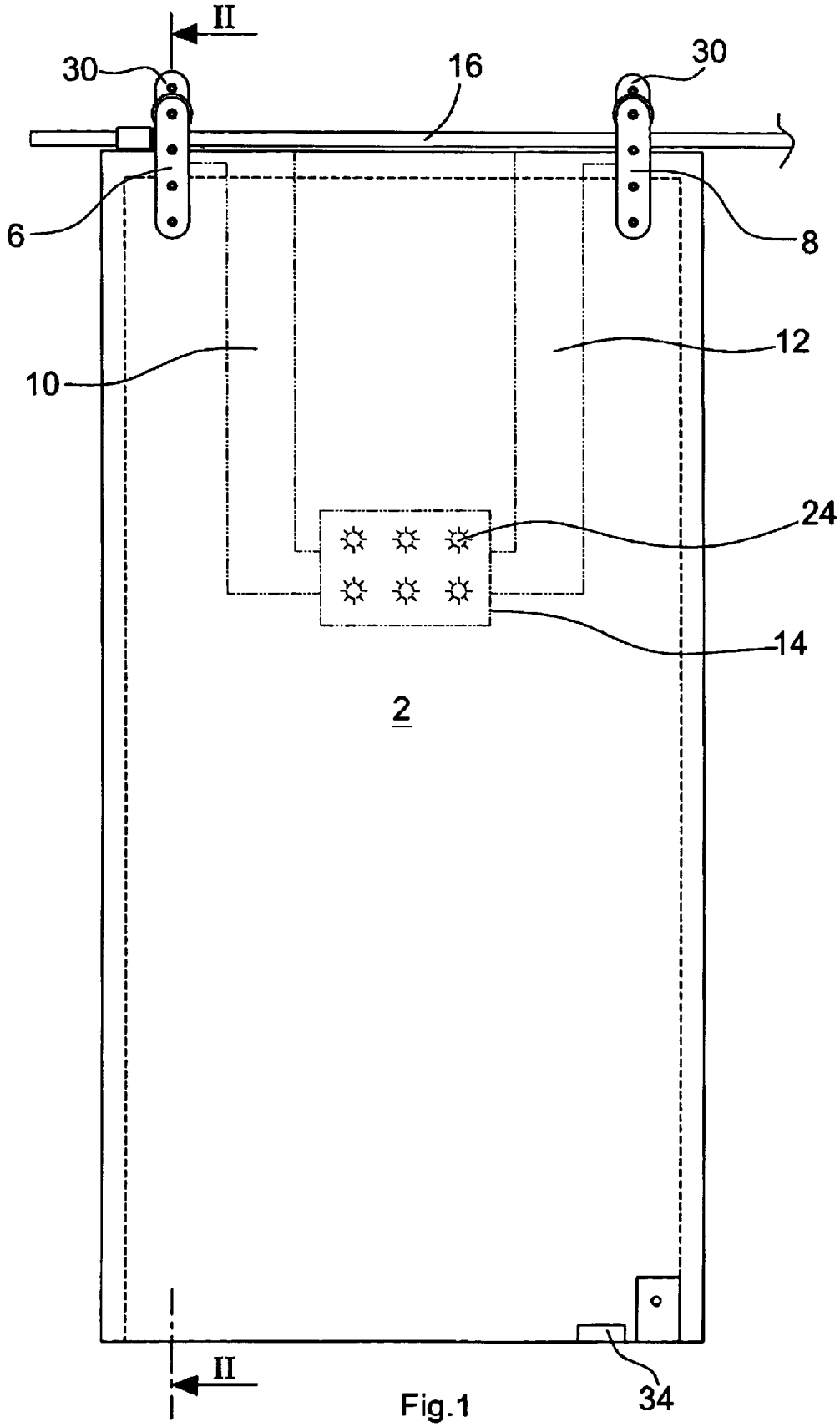
FIG. 1 shows a sliding element system with a sliding door.

FIG. 1 shows a sliding door system with a sliding element 2 of transparent material suspended on a supporting element 4 consisting of a supporting rod 16 by two sliding element fittings 6,8 so as to be laterally displaceable. Alternatively, the sliding element may also consist only partially of transparent material.

Horizontally, the supporting rod 16 is mounted on a wall by means of wall mountings 30 so that the sliding element 2 consisting of a glass door is displaceable along the supporting rod 16.

Preferably, the glass door consists of two glass panes 26,28 with an intermediate plastic layer 3 therebetween in the way of a multilayer glass pane. On the insides of the glass panes 26,28 facing each other, transparent conducting current paths 10,12 produced, e.g., by ITO coatings, are arranged. The current paths 10,12 invisibly supply a power consumer 14 arranged on one of the glass panes 26,28 or between the glass panes 26,28 with power.

The current paths 10,12, which, differing from the illustration in FIG. 1, may also be arranged in a large surface area on the glass panes 26,28, lead to the sliding element fittings 6,8 used to couple the power into the current paths 10,12.

It is also possible that the one glass pane 26 bears the one current path 10 on its complete surface and the other glass pane 28 the other current path 12.

The power consumer 14 arranged on the glass surface of the glass panes 26,28 or between the glass panes 26,28 may be an illumination means with several LEDs 24. According to a further alternative, the power consumer 14 may also be arranged on the sliding element 2, e.g., in a door handle.

Since the current paths are also able to transfer higher currents in the low-voltage range, the operation of sensor and communication means as power consumer 14 is possible.

Glass sliding doors, e.g., in airport areas, can be automatically opened, for example, by means of the sensors, LED diodes additionally forming a warning means so that persons do not walk into the closed glass doors.

Figure 2:
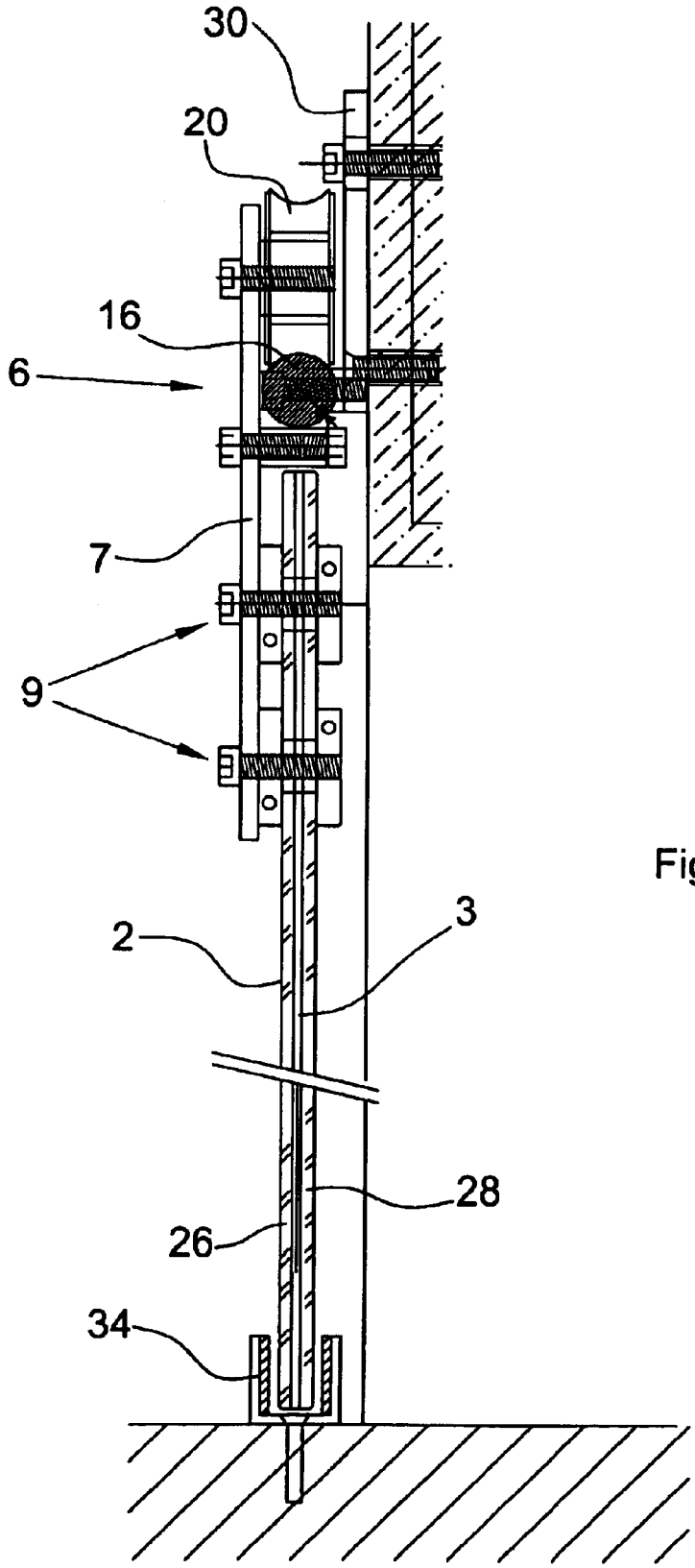
FIG. 2 shows a section along line II—II in FIG. 1.

FIG. 2 shows a cross section of the sliding element fitting 6 of the sliding element system. The sliding element fitting 6 consists of a carrier 7 at the upper end of which a castor 20 rolling on the supporting rod 16 is arranged so as to be rotatably supported.

At the lower end of the carrier 7, provision is made for two mounting means 9 holding the sliding element 2 by means of two fastening screws passed through the sliding element 2. Above the upper edge of the glass panes 26,28, an disengagement preventing means 18 in the form of a bolt is provided, said bolt preventing the castor 20 from being lifted off the supporting rod 16 and thus the sliding element 2 consisting of a sliding door from being levered off.

At the lower end of the sliding door, a guide profile 34 preventing pivotal movements of the sliding door transversely to the displacement direction is provided.

Figure 3:
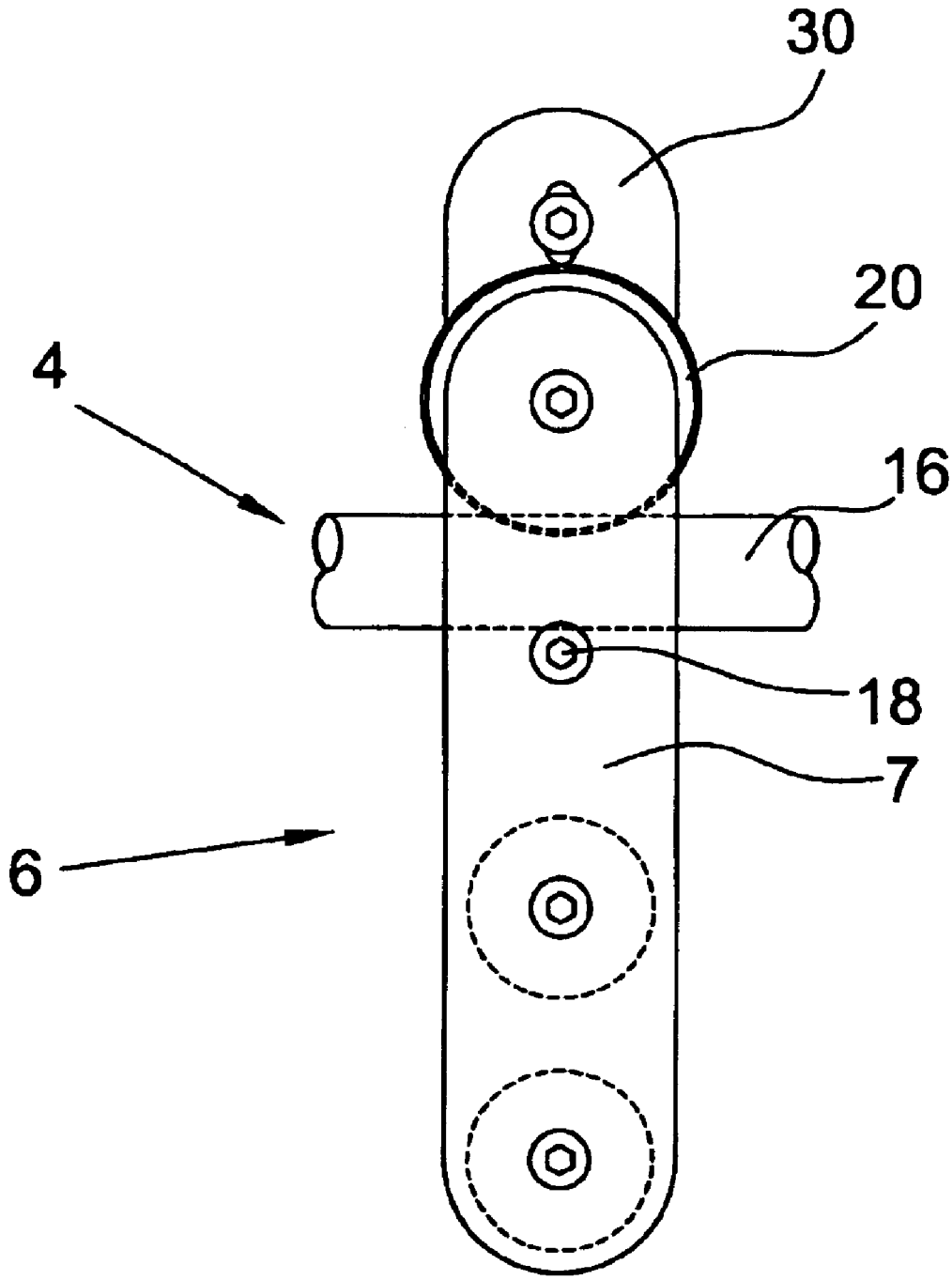
FIG. 3 shows a top view of a sliding door fitting.
Figure 4:
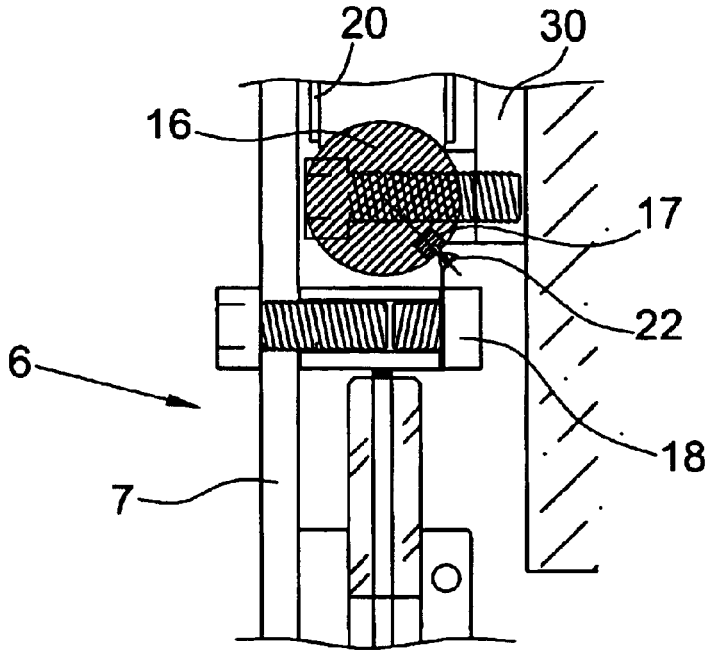
FIG. 4 is a sectional view of the left sliding door fitting in FIG. 1.
Figure 5:
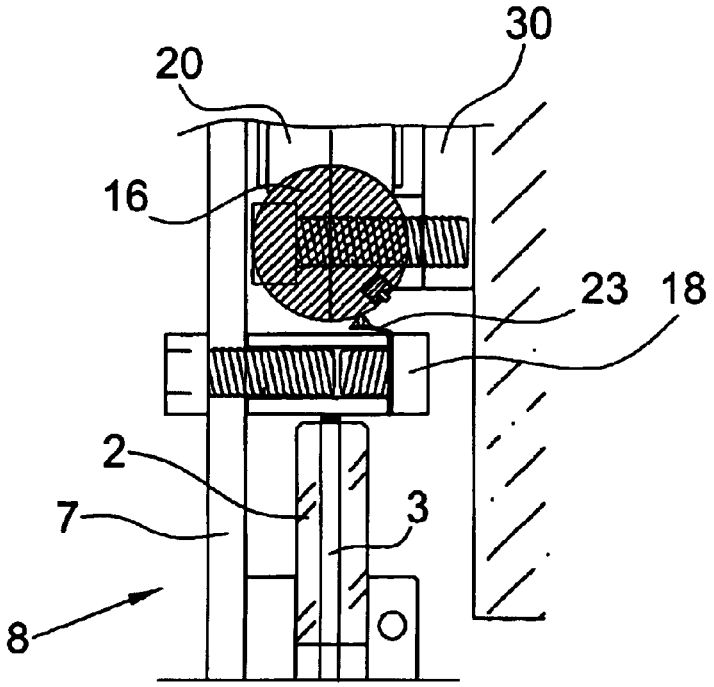
FIG. 5 is a sectional view of the right sliding door fitting in FIG. 1.

FIGS. 3, 4 and 5 show a sectional view in the region of the disengagement preventing means 18 on the sliding element fitting 6 and the sliding element fitting 8, respectively.

As can be seen from FIGS. 4 and 5, the supporting rod 16 comprises a conducting bar 17 inserted into a groove of the supporting rod 16 in an insulated manner. The supporting rod 16 forms the negative pole, whereas the bar 17 inserted in an insulated manner forms the positive pole. A sliding contact 22 mounted to the disengagement preventing means taps off the positive pole from the bar 17, while another sliding contact 23 on the disengagement preventing means 18 of the sliding element fitting 8 taps off the negative pole from the outer circumference of the supporting rod 16. The power, which is preferably in the low-voltage range, is suitably coupled into the supporting rod 16 and the bar 17 at a free end of the supporting rod 16.

The sliding contact is made, e.g., of copper spring steel and is mounted on a bolt of the disengagement preventing means 18 by means of a plate screw. Then, the sliding contact 22 is connected with a power connection of the current path 10 between the glass panes 26,28 at the upper front edge of the glass sliding door, while the sliding contact 23 is connected with a corresponding power connection of the current path 12 at the upper front edge of the sliding element 2 in the region of the sliding element fitting 8.

Thus, the power can be invisibly coupled into a sliding element 2, particularly a sliding door, and a power consumer 14 arranged in the sliding element 2 can be invisibly supplied with power.

It is also possible to realize the suggested solution with sliding door systems in furniture as well as with displaceable table boards provided, at least partially, with transparent inserts, particularly glass surfaces.

Although a preferred embodiment of the invention has been specifically illustrated and described herein, it is to be understood that minor variations may be made in the apparatus without departing from the spirit and scope of the invention, as define by the appended claims.

What is claimed is:

1. A sliding element system comprising at least one sliding element (2), at least one supporting element (4) extending in a displacement direction, at least one sliding element fitting (6, 8) holding the sliding element (2) and being displaceable along the at least one supporting element (4), the sliding element (2) being formed of at least partially transparent material and including at least two transparent conducting current paths (10,12) part, which substantially invisibly supply power to a power consumer (14) of the sliding element (2), the transparent current paths (10,12) of the sliding element (2) being supplied with power via the at least one sliding element fitting (6, 8), said at least one supporting element (4) defining two electrically conductive paths in mutually insulated relationship to each other, the supporting element (4) including at least one supporting rod (16), and the at least one sliding element fitting (6, 8) taps off power from said two mutually insulated electrically conductive paths defined by two longitudinally extending mutually insulated outer peripheral portions of the supporting rod (16) serving as power rails.

2. The sliding element system according to claim 1 wherein the power rails extend paralled to the supporting element (4).

3. The sliding element system according to claim 2 wherein the at least one sliding element fitting (6, 8) includes at least one sliding contact (22) for tapping off power from at least one of the two mutually insulated electrically conductive paths.

4. The sliding element system according to claim 3 wherein the at least one sliding contact (22) is mounted to a disengagement preventing device (18) extending below the supporting element (4).

5. The sliding element system according to claim 1 wherein the sliding element (2) includes at least partially one of a glass pane and a multilayer glass pane.

6. The sliding element system according to claim 1 wherein the two mutually insulated electrically conductive paths of said supporting element (4) are defined by said supporting rod (16) and a conducting bar (17) inserted into a groove of said supporting rod (16) in an insulated manner.

7. The sliding element system according to claim 1 wherein the power consumer (14) of the sliding element (2) includes means for creating illumination.

8. The sliding element system according to claim 7 wherein the illumination creating means comprises LEDs (24).

9. The sliding element system according to claim 8 wherein the LEDs (24) are arranged between two glass panes (26, 28) of the sliding element (2).

10. The sliding element system according to claim 1 wherein said one sliding element fitting comprises two laterally spaced sliding element fittings (6, 8) each of which taps off power from a respective one of said two mutually insulated electrically conductive paths.

11. The sliding element system according to claim 1 wherein the sliding element (2) is a sliding door.

12. The sliding element system according to claim 1 wherein the sliding element fitting (6, 8) comprises at least one castor (20) rolling on the one supporting rod (16).

13. The sliding element system according to claim 12 wherein the at least one castor (20) transfers power from one of the two mutually insulated electrically conductive paths to the sliding element fitting (6, 8).

14. The sliding element system according to claim 1 wherein the power consumer (14) includes an inscription field formed of an LED array.

15. The sliding element system according to claim 14 wherein the LED array is arranged between two glass panes (26, 28) of the sliding element (2).

* * * * *